US010517381B2

(12) United States Patent
Frash

(10) Patent No.: US 10,517,381 B2
(45) Date of Patent: Dec. 31, 2019

(54) REMOVABLE ATTACHMENT SYSTEM FOR PORTABLE POCKET

(71) Applicant: Rabbit Designs LLC, Newburyport, MA (US)

(72) Inventor: Jean Shannon Frash, Newburyport, MA (US)

(73) Assignee: Rabbit Designs LLC, Newburyport, MA (US)

( * ) Notice: Subject to any disclaimer, the term of this patent is extended or adjusted under 35 U.S.C. 154(b) by 0 days.

(21) Appl. No.: 16/180,094

(22) Filed: Nov. 5, 2018

(65) Prior Publication Data

US 2019/0133308 A1 May 9, 2019

Related U.S. Application Data

(60) Provisional application No. 62/583,424, filed on Nov. 8, 2017.

(51) Int. Cl.

| | |
|---|---|
| ***A45F 5/02*** | (2006.01) |
| ***A41D 27/20*** | (2006.01) |
| ***A45C 3/06*** | (2006.01) |
| *A41D 1/06* | (2006.01) |
| *A41B 1/00* | (2006.01) |
| *A41D 1/14* | (2006.01) |

(52) U.S. Cl.

CPC ..... *A45F 5/022* (2013.01); *A41D 27/204* (2013.01); *A41D 27/205* (2013.01); *A45C 3/06* (2013.01); *A45F 5/02* (2013.01); *A41B 1/00* (2013.01); *A41D 1/06* (2013.01); *A41D 1/14* (2013.01); *A45F 2200/0516* (2013.01); *A45F 2200/0541* (2013.01); *A45F 2200/0558* (2013.01)

(58) Field of Classification Search

CPC ... Y10T 24/44034; Y10T 24/3698; A45F 5/02
USPC ..... 224/183, 194
See application file for complete search history.

(56) References Cited

U.S. PATENT DOCUMENTS

| | | | | |
|---|---|---|---|---|
| 1,690,277 A | | 12/1901 | Hatfield | |
| 904,968 A | * | 11/1908 | Kocher | A45F 5/02 24/3.9 |
| 1,142,510 A | | 6/1915 | Engle | |
| 1,423,590 A | | 7/1922 | Zimmerman | |
| 2,731,179 A | * | 1/1956 | Bennett | A45F 5/021 224/673 |
| 3,624,686 A | | 11/1971 | Beals | |
| 3,743,147 A | | 7/1973 | Wilczynski | |
| 4,128,194 A | * | 12/1978 | Hinz | A45C 11/00 224/194 |

(Continued)

*Primary Examiner* — Adam J Waggenspack
(74) *Attorney, Agent, or Firm* — Andrus Intellectual Property Law

(57) ABSTRACT

A removable attachment system for temporarily attaching a portable pocket to an object made of fabric such as clothing, bag, or the like. The system comprises an outer part placed on the front side of the host fabric and an inner part placed on the back side of the host fabric in a manner such that the host fabric is compressed between the two parts thereby securing the two parts in place. The portable pocket being bound to the outer part is thereby quickly and easily attached to any location on the host object requiring no temporary or permanent modification to the host object and affecting no permanent alteration to the host object upon removal of the portable pocket.

6 Claims, 5 Drawing Sheets

(56) References Cited

U.S. PATENT DOCUMENTS

| | | | | |
|---|---|---|---|---|
| 4,266,300 | A | 5/1981 | Partridge | |
| 4,419,794 | A | 12/1983 | Horton et al. | |
| 4,602,390 | A | 7/1986 | Morera et al. | |
| 5,114,061 | A | 5/1992 | Brady | |
| 5,617,587 | A | 4/1997 | Marchbanks | |
| 5,692,272 | A * | 12/1997 | Woods | A44B 99/00 24/115 M |
| 5,927,580 | A * | 7/1999 | Ward-Llewellyn | A45F 5/02 224/194 |
| 6,059,156 | A | 5/2000 | Lehtinen | |
| 6,397,398 | B1 | 6/2002 | Herder | |
| 6,801,140 | B2 | 10/2004 | Mantyjarvi et al. | |
| 7,406,753 | B2 * | 8/2008 | LaScala | E04H 15/64 24/460 |
| 8,646,971 | B2 | 2/2014 | Doyle | |
| 2005/0114988 | A1 | 6/2005 | Dow | |
| 2013/0139298 | A1 | 6/2013 | Crump et al. | |

* cited by examiner

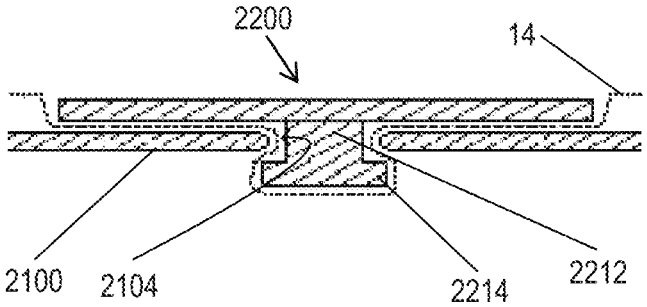
FIG. 3a
FIG. 3b
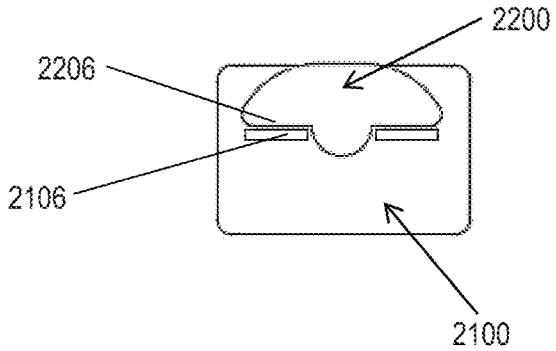
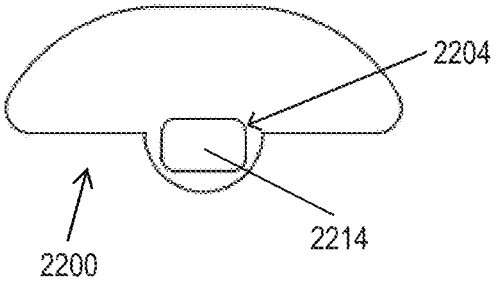
FIG. 3c
FIG. 3d
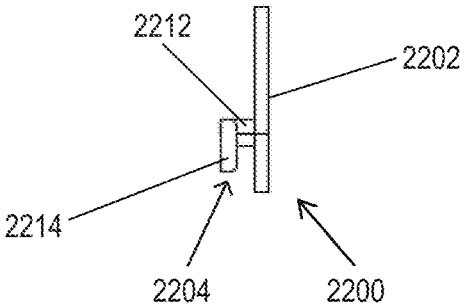

REMOVABLE ATTACHMENT SYSTEM FOR PORTABLE POCKET

CROSS REFERENCE TO RELATED APPLICATIONS

The present application claims priority to U.S. Provisional Application No. 62/583,424 entitled "Removable Attachment System for Portable Pocket" filed Nov. 8, 2017.

FIELD OF THE INVENTION

The present invention relates to portable pockets and more particularly the system used for temporarily attaching portable pockets to objects made of fabric such as clothing, bags, or the like.

BACKGROUND OF THE INVENTION

It is well known in the art to provide a portable pocket for items such as mobile phones, wallets, eyeglasses, keys and the like, which is temporarily attachable to an object made of fabric such as clothing, bag, or the like.

Some portable pockets are attached using a removable adhesive and/or a hook and pile type fastener (i.e. Velcro®) which are both known in the art to lose their holding strength with repeated use and are also both known to be more easily detached if pulled in the normal direction, thus it is possible for these pockets to be unintentionally detached rendering them insecure. It is also well known in the art that removable adhesives can cause damage to some types of fabric when removed.

Other portable pockets attached with clips, straps, snaps or the like, can only be attached to a specific type of object such as a belt or can only be attached in a specific location on an object such as a waistband, cuff or belt loop. These systems may also require a permanent modification to the host object by sewing, using permanent adhesive, or the like. In addition, special tools, materials, or skills are often required to attach one side of the system, such as a loop or clip, to the host fabric.

Portable pocket attachment systems using magnets are also known in the art, but can interfere with devices such as mobile phones, credit cards, key cards and the like.

Thus, a need exists in the art for a portable pocket that can be temporarily attached securely, quickly and easily to any location on an object made of fabric without requiring a permanent modification to the host object or altering the host object upon removal.

SUMMARY OF THE INVENTION

One objective of the present invention is to provide a portable pocket attachment system that can be quickly and easily attached to any desired location on an object made of fabric such as clothing, a bag, or the like.

A second objective of the present invention is to provide a portable pocket attachment system that does not require modification to the host object and does not cause alteration or damage to the host object upon removal.

A third objective of the present invention is to provide a portable pocket attachment system that can support various pocket configurations designed to hold various items such as a mobile phone, wallet, eyeglasses, keys and the like.

A fourth objective of the present invention is to provide a portable pocket attachment system which is capable of attaching to a variety of host fabric types.

Embodiments of the present invention include an attachment system for temporarily attaching a portable pocket securely to an object made of fabric such as clothing, a bag, or the like. The attachment system preferably comprises an outer part, to which a portable pocket can be affixed, configured to be positioned on the front side of the host fabric, and an inner part configured to be positioned on the back side of the host fabric, in a manner such that mating fasteners integrated in the two parts can be pressed, pushed, slid or rotated together thereby compressing the host fabric between the two parts and securing the pocket to the host object. The attachment system allows the pocket to be quickly and easily attached to and removed from any location on the host fabric, requiring no temporary or permanent modification to the host object and affecting no permanent alteration to the host object upon removal. The variable configurations and dimensions of the attachment system parts allow the pocket to be of varying shape and size and allow the pocket to be attached to various types and thicknesses of fabric.

BRIEF DESCRIPTION OF THE DRAWINGS

To provide additional clarification of the present invention, the following drawings are included.

FIG. 3*a* is a detail section view of a portion of the third exemplary embodiment illustrating a fastening knob engaged in a fastening slot securing the host fabric between the two parts.

FIG. 3*b* is a back view of the outer part and inner part together of the exemplary embodiment depicted in FIG. 3.

FIG. 3*c* and FIG. 3*d* are a front view and side view respectively of the inner part of the exemplary embodiment depicted in FIG. 3.

DETAILED DESCRIPTION

Figure 1:
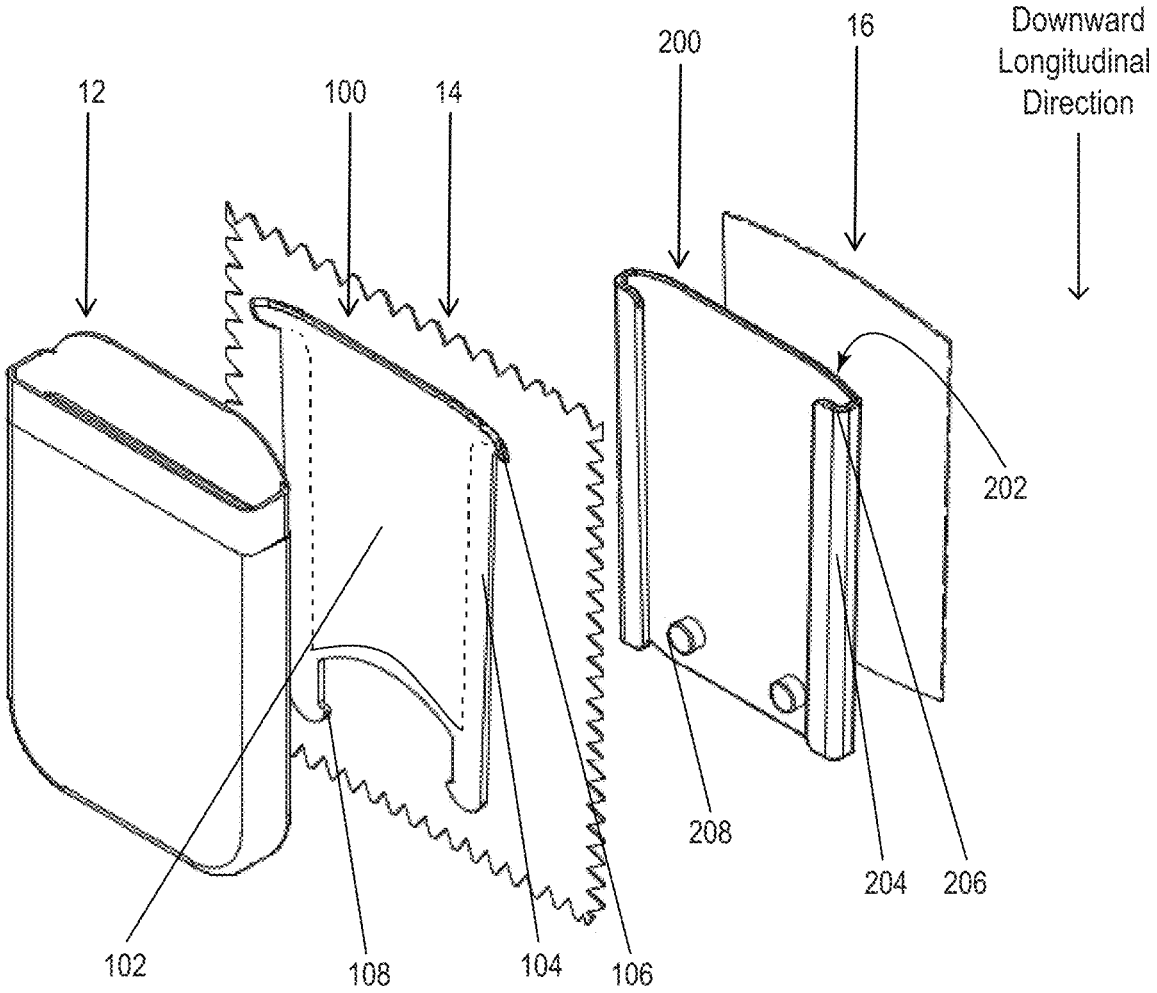
FIG. 1 is an exploded perspective view showing a first exemplary embodiment of the attachment system. For reference purposes, the view includes a portable pocket, fabric of a host object, and an optional cushioning material.
Figure 1A:
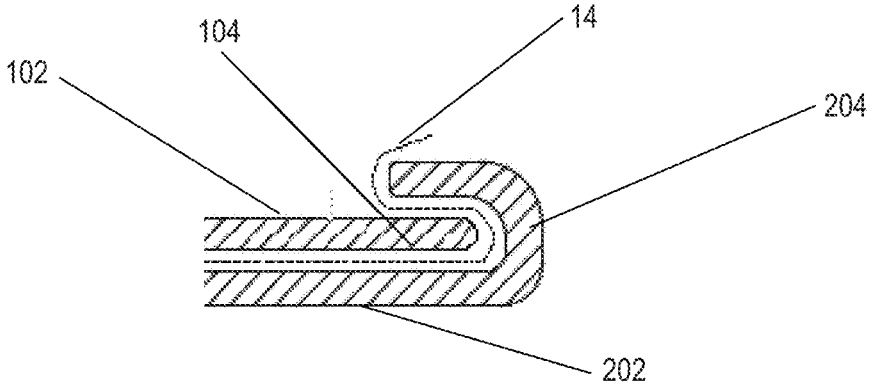
FIG. 1*a* is a detail section view of a portion of the first exemplary embodiment illustrating a fastening edge engaged in a fastening channel securing the host fabric between the two parts.

An exemplary embodiment of the present invention shown in FIG. 1 is a removable attachment system for a portable pocket comprising an outer part 100 and an inner part 200. The outer part 100 comprises a defined portion of the surface area 102 to which a portable pocket can be affixed, two fastening edges 104, and two types of securing features 106, 108. The inner part 200 comprises two fastening channels 204, two types of securing features 206, 208 and a defined surface to which a cushioning material can be affixed 202. On the outer part 100, the defined portion of surface area 102 to which the pocket is attached includes the upper top edge of the outer part which allows the top of the pocket 12, or a flap attached to the top of the pocket 12, to bend or fold over the top edge of the outer part 100 for added security. As shown by the dashed lines, the defined pocket attachment area 102 leaves the fastening edges 104 free for a width slightly greater than the depth of the fastening channels 204 so as not to obstruct the mating fasteners 204. Referring to FIG. 1*a*, the fastening edges 104 and fastening channels 204 are dimensioned so that the host fabric 14 wraps around the respective fastening edge 104 and compresses within the respective fastening channel 204 when the fastening edges 104 are slid longitudinally downward snugly into position within the fastening channels 204. FIG. 1*a* shows a detail section view of the host fabric 14 being shaped by the fastening edge 104 engaged in the fastening channel 204. One type of securing feature 106, 206 comprises an outward lateral tab 106 at the top of each fastening edge 104 of the outer part 100. The tab 106 encounters the top of the fastening channels 206 on the inner part 200 through the fabric 14 thereby preventing the pocket 12 from over travel in the downward longitudinal direction due to the interference between the two parts 106, 206. A second type of securing feature 108, 208 comprises two securing tabs 108 on the outer part 100 and two securing blocks 208 on the inner part 200. Each securing tab 108 and each securing block 208 are dimensioned to create a tight spot, or pinch point, near the lower end of the mating fasteners requiring a greater downward force to slide the securing tabs 108 past the securing blocks 208. This prevents the pocket 12 from withdrawing in the upward longitudinal direction due to the interference between the two parts 108, 208. According to this embodiment, the portable pocket 12 is securely affixed to the defined portion of surface area 102 on the outer part 100 by sewing, adhesives, plastic weld or the like. The outer part 100 is positioned on the front side of the host fabric 14 and the inner part 200 is positioned on the back side of the host fabric 14. When the two parts 100, 200 are slid into place, the host fabric is compressed between them frictionally securing the pocket 12 in place. Optional cushioning material 16 can be affixed to a defined surface 202 on the inner part 200 for added comfort for the user. In other embodiments of the invention, the securing features and cushioning material are not necessary; however these options render the pocket attachment system especially good for use with clothing worn during activities such as biking, running, yoga, gymnastics, and the like.

FIG. 4 shows a variety of representative objects to which the portable pocket 12 can be attached, for example: a) to a T-shirt, b) to yoga pants, c) to a skirt, d) to a handbag, or e) to a pair of pants.

The method of using the embodiment of the removable attachment system for a portable pocket described in FIG. 1 is described below. First, the inner part 200 is positioned inside the fabric 14 on the back side of the fabric 14 in the desired location and orientation in which the user wishes to attach the pocket 12. The outer part 100, with the pocket 12 affixed, is placed against the front side of the fabric 14 such that the bottom of the fastening edges 104 are aligned with the top of the inner part fastening channels 204. The fabric 14 is pressed into the top of the fastening channels 204, the outer part 100 is slid down keeping the fastening edges 104 inside the inner part fastening channels 204 until the lower securing tabs 108 snap into place past the inner part securing blocks 208. When desired, the pocket 12 can be removed by pulling upward on the top of the outer part 100 while pushing down on the inner part 200 to force the securing tabs 108 past the securing blocks 208. The outer part 100 is then slid up until it is free from the inner part channels. Both parts 100 and 200 should be together.

Figure 2:
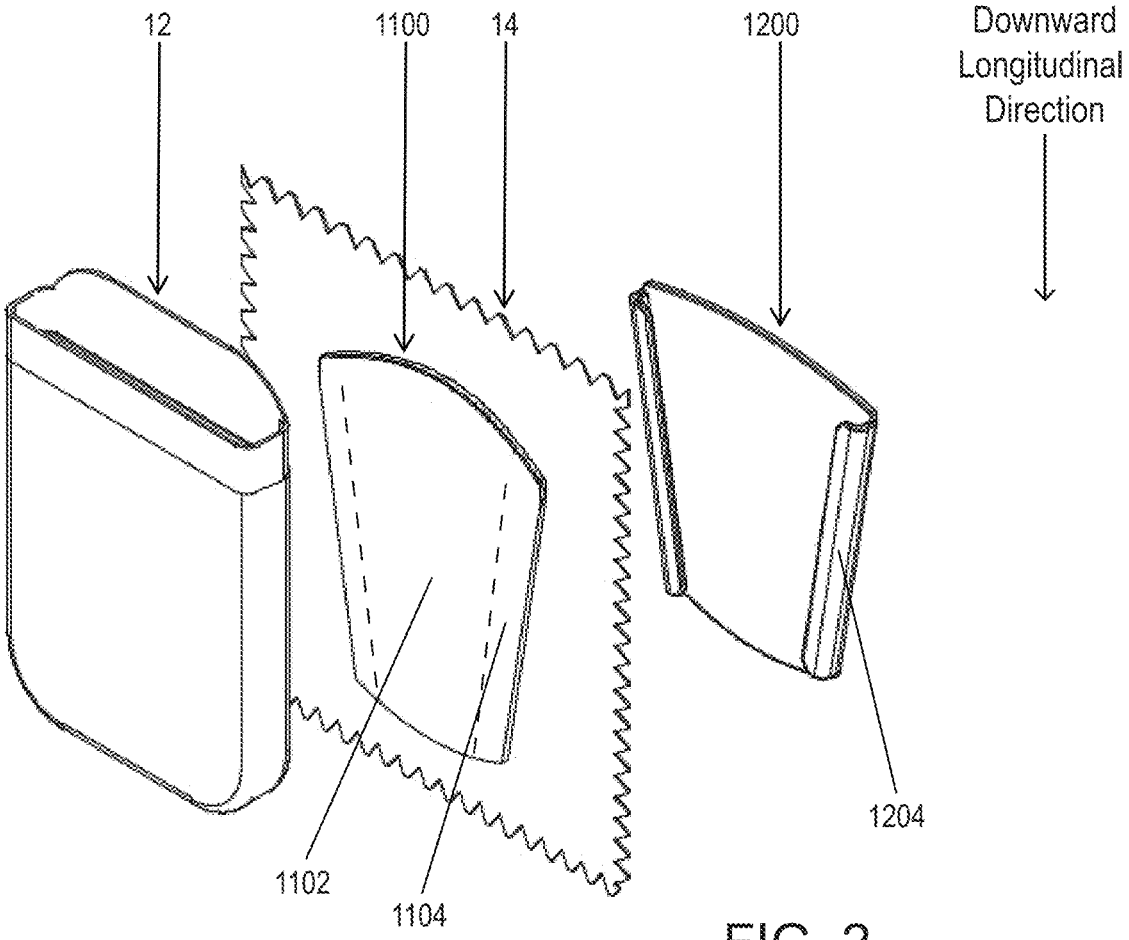
FIG. 2 is a similar view to FIG. 1 showing a second exemplary embodiment of the attachment system with two tapered sliding fasteners.
Figure 2A:
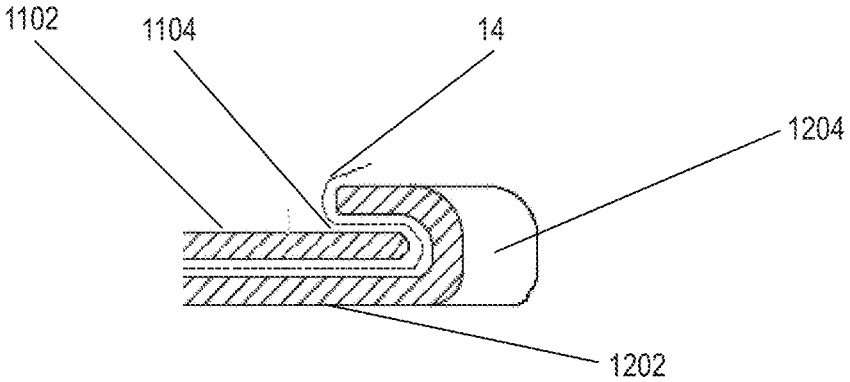
FIG. 2*a* is a detail section view of a portion of the second exemplary embodiment illustrating a tapered fastening edge engaged in a fastening channel securing the host fabric between the two parts.

Another exemplary embodiment of the present invention is shown in FIG. 2. In FIG. 2, the outer part 1100 comprises a defined surface 1102, illustrated by dashed lines, to which a portable pocket 12 can be affixed, and two free tapered fastening edges 1104. The inner part 1200 comprises two tapered fastening channels 1204. In this embodiment, the outer part 1100, with a portable pocket 12 affixed, is positioned on the front side of the host fabric 14 and the inner part 1200 is positioned on the back side of the host fabric 14. When the outer part 1100 is pressed toward the inner part 1200 and pushed downward longitudinally, the tapered fastening edges 1104 slide within the tapered fastening channels 1204 compressing the host fabric 14 between the two parts 1100, 1200. Similar to the embodiment in FIG. 1, the dimensions of the fastening edges 1104, the host fabric thickness 14, and the fastening channels 1204 secure the attachment system in the lateral direction. FIG. 2*a* shows a detail section view of the host fabric 14 being secured by the tapered fastening edge 1104 of the outer part 1100 engaged in the tapered fastening channel 1204 of the inner part 1200. The mechanical geometry of the coinciding taper in the mated fastening parts 1104, 1204 prevents the outer part 1100 from over travel downward within the inner part 1200, thereby securing the pocket 12 in the downward longitudinal direction. This embodiment of the present invention relies on the frictional interference between the two parts 1100, 1200 and the host fabric 14 to secure it in the upward longitudinal direction. In addition, while the pocket 12 is oriented upright, the gravitational weight of the pocket 12 along with the weight of any items within the pocket 12 prevents the outer part 1200 from withdrawing in the upward direction. This embodiment is especially good for clothing worn during mild upright or sedentary activities or for stationary purposes. The inner part 1200 in the embodiment in FIG. 2 does not have the securing blocks 208 like the embodiment shown in FIG. 1. The outer part 1100 in the embodiment in FIG. 2 does not have securing tabs 106 or 108 as shown in the embodiment in FIG. 1. However, the taper of the fastening channels 1204 in the embodiment shown in FIG. 2 is more aggressive than the taper of the fastening channels 204 in the embodiment shown in FIG. 1.

Figure 3:
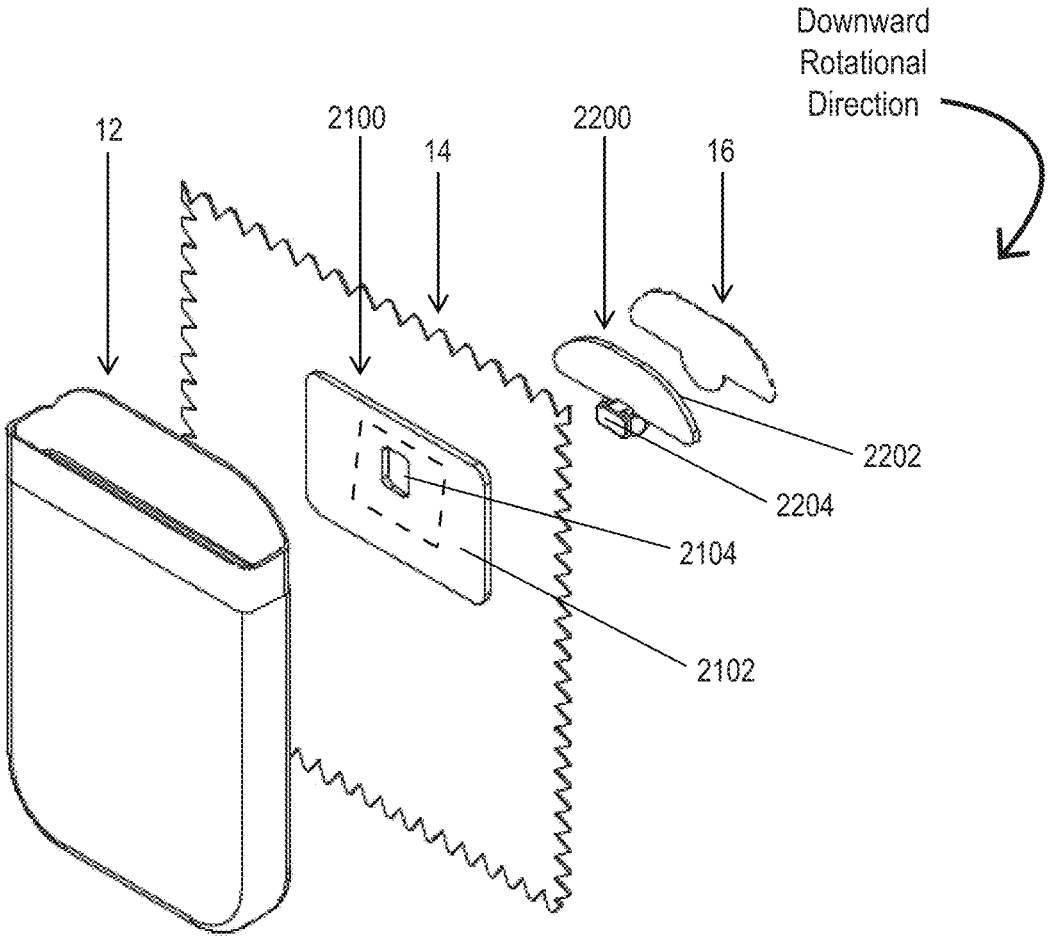
FIG. 3 is an exploded perspective view showing a third exemplary embodiment of the attachment system with a rotatable fastener.
Figure 4A:
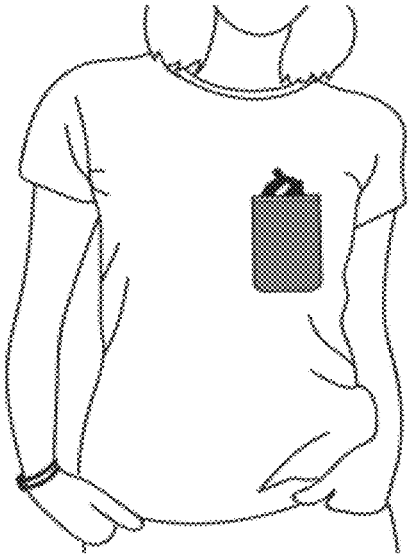
FIGS. 4*a* through 4*e* depict exemplary pocket configurations attached to exemplary objects.
Figure 4C:
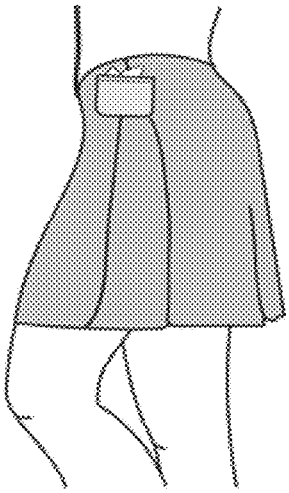
Figure 4D:
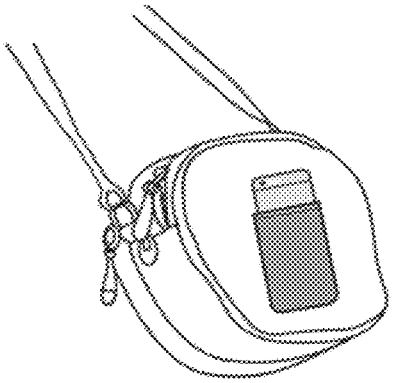
Figure 4B:
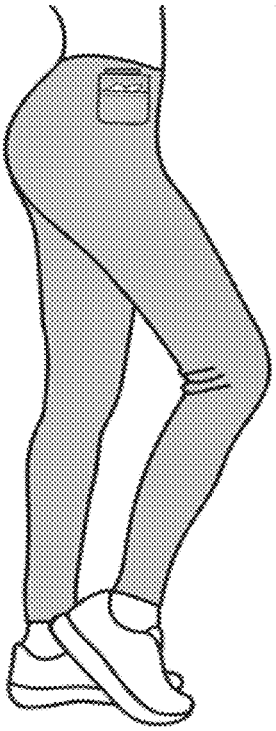
Figure 4E:
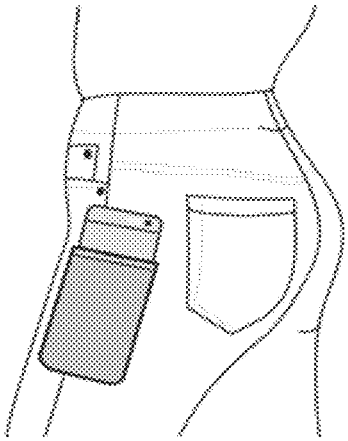

In another embodiment of the present invention, shown in FIG. 3, the outer part 2100 comprises a smaller defined surface 2102, illustrated as the surface area outside the dashed lines, to which a portable pocket 12 can be affixed. The outer part 2100 has a fastening slot 2104, and two raised ridges 2106 on the back side of the outer part 2100, see FIG. 3*b* which shows the back side of the outer part 2100 with the inner part 2200 inserted into the outer part 2100 as explained below in more detail. FIG. 3*b* shows the parts 2100, 2200 engaged without the host fabric 14 between the parts for purposes of illustration, however it should be understood that fabric 14 would normally be between the parts 2100, 2200 when the attachment system is in use. The inner part 2200 comprises a fastening knob 2204, and optionally a defined surface 2202 on the back side of the part 2200 to which a cushioning material can be affixed. FIGS. 3*c* and 3*d* show front and side views respectively of the inner part 2200, and best illustrate the geometry of the fastening knob 2204 which comprises a rectangular post 2212 and a rectangular plate 2214. The fastening knob post 2212 and fastening knob plate 2214 are dimensioned such that when aligned at a 90 degree orientation to the position shown in FIG. 3*a*, the fastening knob 2204 can be easily inserted into the rectangular fastening slot 2104 on the outer part 2200 with allowance for thickness of the host fabric 14. The fastening knob post 2212 and fastening knob plate 2214 are also dimensioned such that when aligned in the position shown, the long ends of the rectangular plate 2214 overlap the short edges of the rectangular fastening slot 2104 and the long ends of the rectangular post 2212 fit snugly within the short edges of the rectangular fastening slot 2104. FIG. 3*a* shows a detail section view of the host fabric being secured by the fastening knob 2204 engaged in the fastening slot 2104. According to this embodiment of the invention, the outer part 2100, with a portable pocket 12 affixed, is positioned on the front side of the host fabric 14 and the inner part 2200 is positioned on the back side of the host fabric 14 in a manner such that when the outer part 2100 is turned 90 degrees, then pressed along with the host fabric 14 to place the fastening knob 204 through the slot 2104 in the outer part 2200. Then the outer part 2200 is rotated downward, and the mechanical geometry of the mated fastening parts 2104, 2204 secures the pocket 12 in both lateral and longitudinal directions to the host fabric 14. As shown in FIG. 3*b*, raised ridges 2106 on the outer part 2100 encounter the lower edges 2206 on the inner part 2200 when the pocket 12 is installed, thereby preventing the inner part 2200 from over rotating and counter rotating once the part 2100 is in the attached position. This embodiment of the present invention is especially good for smaller pockets or for activities where the pocket can swing freely about a single point of attachment without bothering the user.

In all the described embodiments of the invention, the dimensions of the mating fasteners and securing features can be adjusted to accommodate various types and thicknesses of fabric. The overall size and shape of the outer and inner parts are variable as well to accommodate various pocket configurations.

There are various other embodiments of this invention including but not limited to: a portable pocket attachment system comprising a two piece outer part and a two piece inner part that attach using one or more of the fastening methods described previously; a portable pocket attachment system comprising an outer part and an inner part that attach laterally as opposed to longitudinally; a portable pocket attachment system comprising an outer part and an inner part that attach using a rotatable fastening method within an arc shaped channel; a portable pocket attachment system comprising a fastening knob and slot as a securing feature; a portable pocket attachment system comprising an outer part and an inner part that attach using one straight fastening channel and one tapered fastening channel; a portable pocket attachment system comprising an inner part flexible fastening channel that bends or clips over an outer part edge as a securing feature.

An exemplary mode of manufacturing the present invention follows. The two parts, i.e. the inner part and the outer part, of the removable attachment system for a portable pocket are desirably constructed of plastic. A 3D CAD model for each part is dimensioned for the pocket shape desired as well as the thickness of the host fabric. The two CAD models are then either 3D printed, injection molded, machined, or the like, of a plastic with sufficient properties to withstand the applied stresses due to compressing the fabric between them. The two parts are then inspected on all surfaces that contact the host fabric and any rough or sharp edges are smoothed and/or rounded. A prefabricated or custom made pocket is then bound, using adhesive, plastic weld, sewing, or the like, to the defined surface of the outer part designated for the pocket so as not to obstruct the free edges of the outer part. A mounting flap can be sewn or attached to the back of the pocket to use for attaching to the outer part if needed. If desired for added comfort when the pocket is attached to wearing apparel, the entire back side of the inner part is then bound to a cushioning material using adhesive, plastic weld or the like. The two finished parts, together with the attached pocket, make a complete removable portable pocket.

Although the invention has been described in detail with reference to certain preferred embodiments, other embodiments are possible. Therefore, the spirit and scope of the appended claims should not be limited to the description of the exemplary embodiments contained herein.

What is claimed is:

1. A removable attachment system for a portable pocket comprising:

an outer part having one or more defined portions of its surface area to which a portable pocket is affixed, the outer part having two fastening edges that are free from the affixed pocket and two securing tabs each extending downward from a respective fastening edge;

an inner part having two fastening channels dimensioned to receive the fastening edges together with the compressed thickness of a host fabric, said fastening channels alignable with said fastening edges of the outer part such that when said outer part is positioned on the front side of the host fabric and together with the host fabric is pressed into top openings of the fastening channels of the inner part, oriented on the back side of the host fabric, after which said outer part is pushed in a longitudinal direction such that the fastening edges together with the host fabric are received within said fastening channels firmly compressing the host fabric within said fastening channels, thereby securing the pocket to the host fabric in the lateral direction due to the mechanical geometry of said fastening channels and said fastening edges;

wherein the inner part also has two securing blocks, each securing block located between the fastening channels and spaced apart from the respective fastening channel, each securing block defining a respective space for the respective securing tab on the outer part to pass when the outer part is inserted into the fastening channels of the inner part with the host fabric therebetween;

and further wherein each respective securing block on the inner part is positioned such that when the respective securing tab is pushed forcibly through the respective space between the respective fastening channel and the respective securing block and past the respective securing block, it compresses the host fabric between said securing tab and said securing block such that contact between said securing tabs, the host fabric and said securing blocks prevents unintentional reverse longitudinal motion.

2. The removable attachment system for a portable pocket of claim 1 wherein:

each said fastening edge is tapered laterally inward; and each said fastening channel is also tapered laterally inward such that when the respective fastening edge is pushed in the longitudinal direction to the point at which the lateral distance between the two outer edges of said outer part, added to the compressed thickness of the fabric, is approximately the same dimension as the lateral distance between the inside surfaces of said fastening channels, further longitudinal motion is prevented.

3. The removable attachment system for a portable pocket of claim 1 wherein:

the outer part has one or more holding tabs; and the inner part has one or more forward stopping blocks, each respective holding tab on the outer part being alignable with a respective stopping block on the inner part, and oriented in a manner such that when said outer part is pushed in the longitudinal direction, the respective one or more holding tab will engage the respective holding block compressing the host fabric between said holding tab and holding block, to prevent further longitudinal motion.

4. The removable attachment system for a portable pocket of claim 1 wherein each said inner part having one or more defined portions on the inner surface to which a cushioning material can be permanently affixed for the purpose of additional comfort to the user.

5. The removable attachment system for a portable pocket of claim 1 wherein each said outer part and each said inner part are constructed of 3d printable plastic.

6. The removable attachment system for a portable pocket of claim 1 wherein each said outer part and each said inner part are constructed of injection moldable plastic.

* * * * *